US006822154B1

(12) United States Patent
Thai

(10) Patent No.: US 6,822,154 B1
(45) Date of Patent: Nov. 23, 2004

(54) MINIATURE MUSICAL SYSTEM WITH INDIVIDUALLY CONTROLLED MUSICAL INSTRUMENTS

(75) Inventor: Vincent T. T. Thai, Kowloon (HK)

(73) Assignee: Sunco Ltd., Kowloon (HK)

( * ) Notice: Subject to any disclaimer, the term of this patent is extended or adjusted under 35 U.S.C. 154(b) by 0 days.

(21) Appl. No.: 10/645,416

(22) Filed: Aug. 20, 2003

(51) Int. Cl.[7] ..... G10H 7/00; G10H 1/36; G04B 13/00

(52) U.S. Cl. ..... 84/609; 446/408

(58) Field of Search ..... 84/600–602, 609; 446/318, 408

(56) References Cited

U.S. PATENT DOCUMENTS 1,348,386 A * 8/1920 Wronowski ..... 446/265
1,462,006 A * 7/1923 Hall ..... 40/419
4,169,335 A * 10/1979 Betancourt ..... 446/297
4,949,327 A * 8/1990 Forsse et al. ..... 369/53.31
5,040,319 A * 8/1991 Wang et al. ..... 40/414
5,270,480 A * 12/1993 Hikawa ..... 84/645
5,438,154 A * 8/1995 Segan et al. ..... 84/600
5,550,319 A * 8/1996 Segan et al. ..... 84/103
6,110,000 A * 8/2000 Ting ..... 446/302
6,682,392 B2 * 1/2004 Chan ..... 446/335

* cited by examiner

*Primary Examiner*—Jeffrey W Donels
(74) *Attorney, Agent, or Firm*—Jensen & Puntigam, P.S.

(57) ABSTRACT

The miniature self-controlled musical system includes a plurality of musical instrument assemblies including a drummer, a bass guitar, a guitar and a turntablist. Each assembly represents the selected musical instrument and includes a processor/storage member for storing musical sounds associated with the musical instrument for a particular pre-programmed song. Each musical assembly also includes a speaker member for playing the musical sounds and a control switch for controlling the on-off status of the musical instrument assembly. The system also includes initiating control (selection) elements on each musical assembly for selecting one musical instrument assembly as a master assembly member for a particular pre-recorded song and for communicating control information from the selected master assembly to the remaining musical assemblies to play the particular song.

11 Claims, 3 Drawing Sheets

FIG.3

FRANKLINSTEIN/ DRUMMER AS MASTER:

| INITIAL | END |
|---|---|
| 1 LET'S HIT IT | UH..HUH...I'M BAD |
| 2 YES! | DUDE, WHERE ARE MY TACOS |
| 3 CHECK OUT THESE FAT DRUMS | YES! |

THE MUMMY/ BASS AS MASTER:

| INITIAL | END |
|---|---|
| 1 HEY! | THIS BASS IS WICKED |
| 2 GET OFF MY FOOT | SO DO YOU LIKE THE MUSIC, PUNK |
| 3 SO DO YOU LIKE THE MUSIC, PUNK | GET OFF MY FOOT |

DJ AS MASTER:

| INITIAL | END |
|---|---|
| 1 RIGHT ON! RIGHT ON! | STAND BACK! I'M SCRATCHING |
| 2 STAND BACK! I'M SCRATCHING | LET'S JAM |
| 3 LET'S JAM | RIGHT ON! RIGHT ON! |

GUITAR AS MASTER

| INITIAL | END |
|---|---|
| 1 OY! LET'S ROCK THIS PLACE | BOY BANDS! HEH! DRIVE ME BATTY |
| 2 PIZZA! HOLD THE GARLIC! | LAUGH.....COUGH.... |
| 3 WHAT ARE YOU DOING! YOU DON'T TOUCH MY GUITAR! | LOT'S MORE KETCHUP! |

MINIATURE MUSICAL SYSTEM WITH INDIVIDUALLY CONTROLLED MUSICAL INSTRUMENTS

TECHNICAL FIELD

This invention relates generally to automatically controlled miniature musical systems comprising a plurality of simulated musical instruments with associated sounds which together form a musical band, such as for instance a rock band, to play pre-programmed tunes.

BACKGROUND OF THE INVENTION

Individual stand-alone miniature (toy) musical instrument assemblies, which include speakers to produce pre-programmed musical sounds associated with the particular musical instrument are known. However, such individual stand-alone instruments, including guitars, drums, etc., are by themselves quite limited, cannot produce a true combined "band" sound effect, and further do not include other possible band members, such as a turntablist who may "play" a turntable as a musical instrument.

Hence, it would be desirable to have a miniature programmed musical system which is arranged and controlled to play like a real band, in particular a rock band.

SUMMARY OF THE INVENTION

Accordingly, the present invention is a miniature, self-controlled musical system, comprising: a plurality of musical instrument assemblies, each assembly representing a selected musical instrument and including a processor/storage member for storing musical sounds associated with said musical instruments for a particular pre-programmed song for playing the musical sounds, and a control member for controlling the operating status of the musical instrument assembly; an initiating control element associated with each musical instrument assembly for selecting that musical instrument assembly as a master assembly for a particular pre-programmed song; and means for communicating control information from the selected master assembly to the remaining musical assemblies to initiate or play the particular song.

BRIEF DESCRIPTION OF THE DRAWING

FIG. 3 is a table setting forth several opening and end phrases spoken by a selected master band member of the simulated miniature band of FIG. 1 during a pre-programmed tune/song.

BEST MODE FOR CARRYING OUT THE INVENTION

Figure 1:
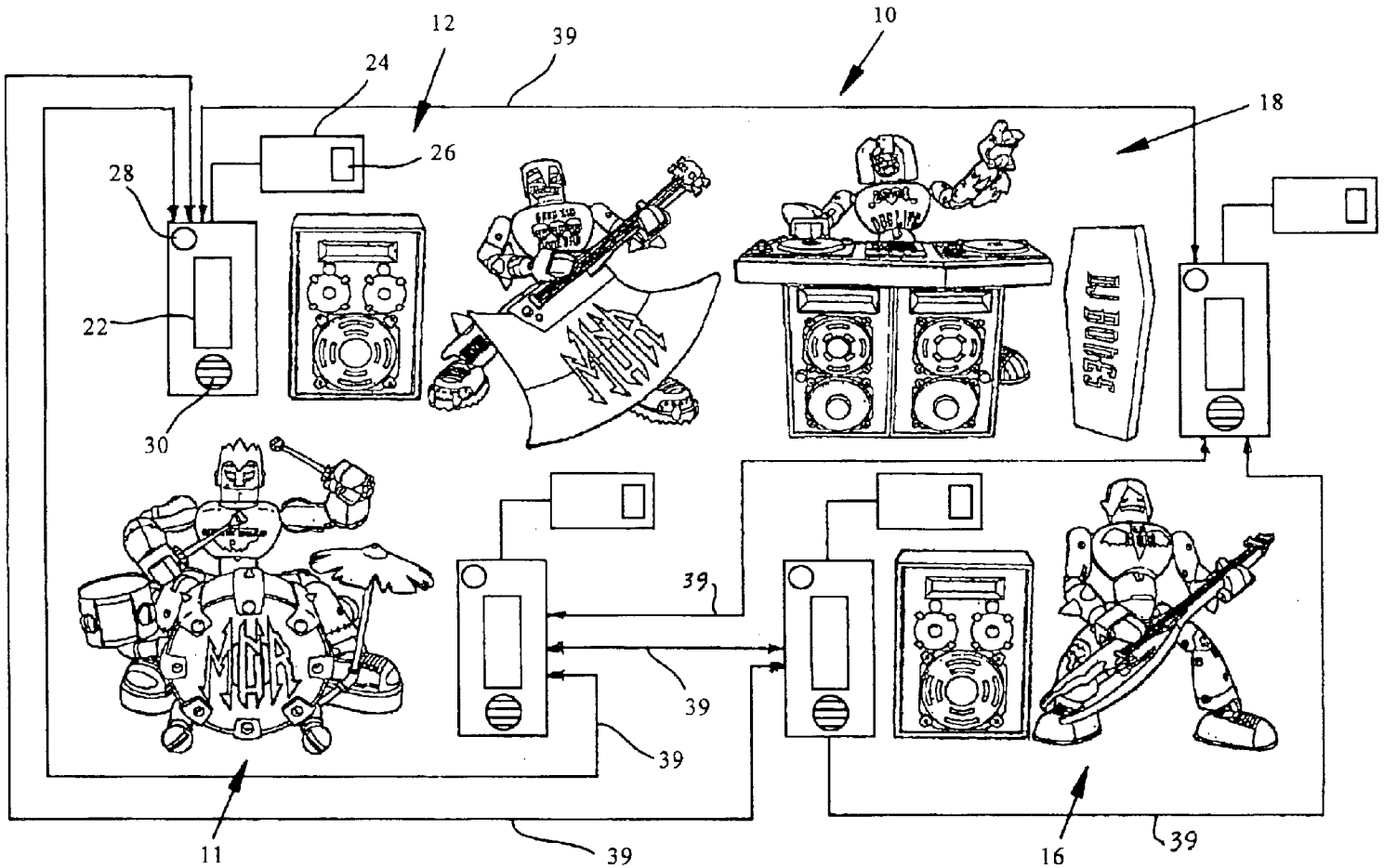
FIG. 1 is a diagram showing the instruments/assemblies of the miniature simulated band of the present invention.

FIG. 1 shows the basic system of the present invention. It includes a plurality of miniature musical instrument assemblies and a turntablist assembly, which again can equate to another musical instrument assembly. Specifically, the system 10 includes a drum assembly 11, a bass assembly 12, a guitar assembly 16 and a turntablist (deejay) assembly 18. Each musical assembly includes a physical representation of a musical instrument assembly/band member. For instance the drummer assembly will include a miniature representation of a drum set and a drummer action figure seated at the drum set; the bass includes a simulated bass speaker and an action figure holding a bass instrument in a playing position.

In one embodiment, each player has a name, for instance Franklinstein Fright the drummer and Skinny Gawz the bassist. In the present system there is in addition a guitarist assembly, with a similar arrangement to the bassist assembly and a turntablist (deejay) assembly which includes a turntable system and an action figure standing behind the turntable. Each musical assembly, for example bassist 12, will have a pre-recorded (pre-programmed) musical portion for a given song, such as a rock song, associated with that instrument, e.g. the microprocessor 22 for the bass instrument will have a pre-recorded bass portion for each song. Each musical instrument assembly will further have its own source of power 24, such as a battery, an on-off switch 26 which controls whether the assembly will play a particular song and a control switch 28, that determines which of the musical instrument assemblies is the master control for a particular song. In one embodiment, not shown, each pre-recorded song will have a separate control switch on each musical instrument to "wake up" or activate the other instruments. In this embodiment, all switches have the ability to perform selected functions and also "wake up" (power up) the instruments. In other embodiments, however, a single switch could be programmed to be multi-song based.

Each musical instrument assembly will also include an actual speaker 30 or speakers, which produce the musical sounds associated with the instrument for the various programmed songs in the system.

Each musical instrument assembly includes each of the above elements; the turntablist (deejay) assembly may also produce musical sounds, as well as audible spoken sounds.

The microprocessor/storage unit for each musical instrument assembly will include its associated portion of the musical sounds for that instrument for one or more pre-programmed songs in the system, i.e. the drum musical instrument assembly will include and produce appropriate drum sounds for a song, the bass guitarist musical instrument assembly will produce the appropriate bass guitar sounds for the song, etc.

The stored musical sounds for all the musical instrument assembly are then coordinated and sequenced to produce a true, band-like sound, with all the instruments playing together with their appropriate parts. Further, each musical instrument assembly will include one or more stored "solo" portions for each song, so that during the playing of a given pre-programmed song, under the control of a master, each individual musical assembly has its own (or at least some do) "solo" interlude in which they alone play, depending on the song being played. In some cases only one musical instrument will have one or more solo parts. In other songs, more than one or all of the musical instrument assemblies will have a solo part.

Each pre-programmed song is initiated by a control signal from a selected master musical instrument assembly preselected from among the group for that song, which could include the turntablist. For the pre-programmed songs, the sequence is initiated by a control signal from the selected master, but the song may include a portion where the master looks for other musical assemblies, waits to receive a response and then begins asking any assembly present to play.

In the present invention, each musical instrument assembly (including the turntablist) can act as a master. In each case, the control (selection) switch of the musical instrument assembly which is to be the master is turned on, while the corresponding control switches for the other musical instrument assemblies are turned to the off position. Each instrument musical assembly can thus initiate the play and subsequent control of the band for any of the pre-programmed songs.

In the embodiment shown, communication between the individual musical instrument assemblies is by infrared communication shown by dotted lines 39, although other communication means, including wired electrical communication, can be used. However, infrared is desirable, since no separate wiring is necessary.

Figure 2:
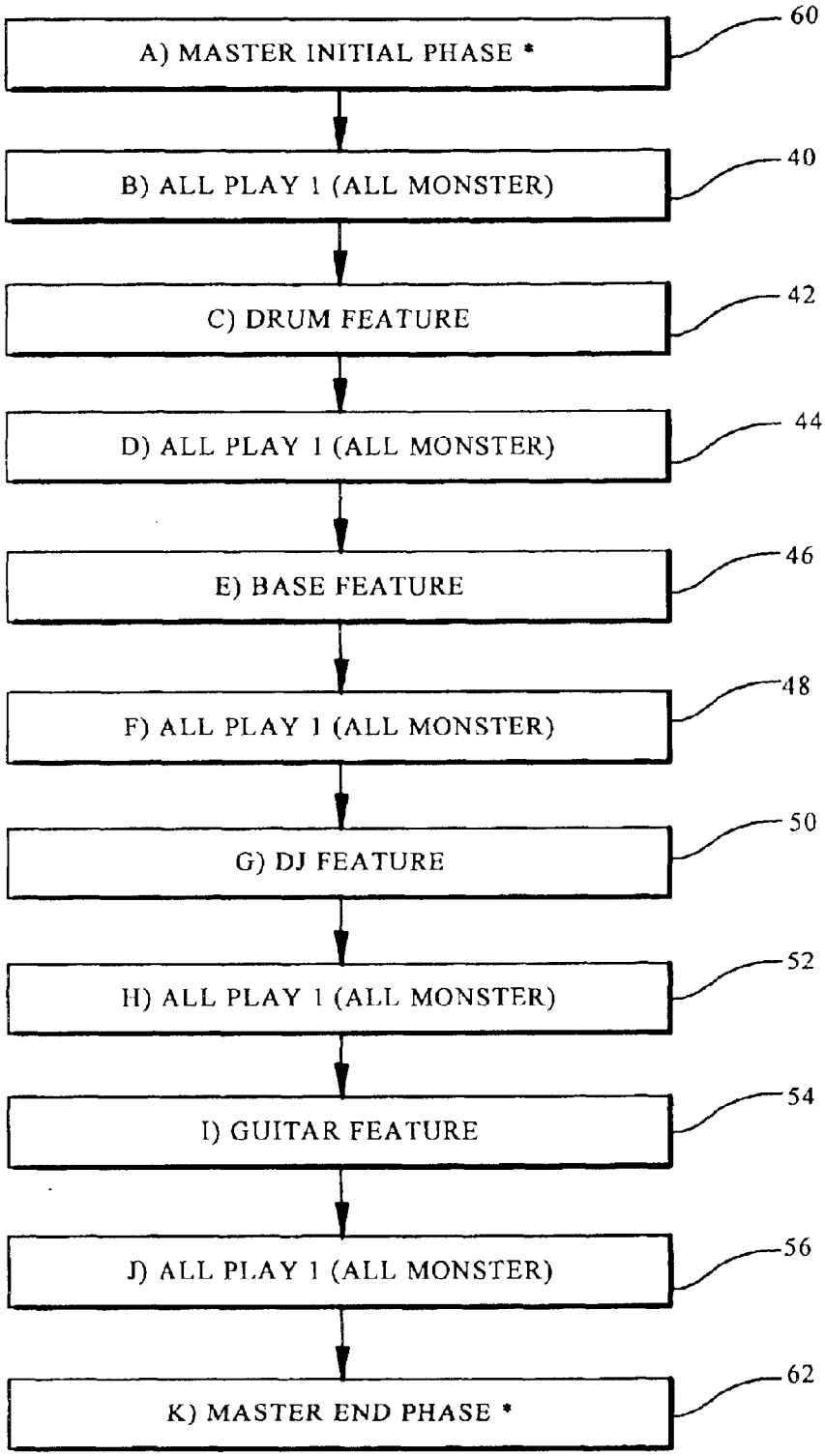
FIG. 2 is a flow chart showing an example of one sequence of control over the individual band members of the system of FIG. 1.

FIG. 2 shows one particular sequence of operation of the band system of musical instrument assemblies of the present invention. After a particular musical instrument assembly is selected to be the master, and if all musical assemblies are operating (present), by virtue of all the operating switches being on, the first step in the play sequence will be a master initial phrase spoken by the selected master musical assembly for that song, at step 60. This spoken phrase will be discussed in more detail below. If there is only one musical instrument assembly present (selected), there will be no initial and end phrases spoken.

In the next step, the individual musical instrument assemblies are controlled to all play their corresponding parts at the same time, shown at step 40. In the next step of the particular sequence of FIG. 2, the drum feature/solo is initiated, shown at 42, during which the drum has a solo part to play, while the other instrument assemblies are silent. After the drum feature, the musical instrument assemblies are all directed by the master to play their respective instrument parts for a given pre-programmed song, shown at step 44.

In the next step, shown at 46, the bass guitar is featured as a solo, with the other instrument assemblies silent; following that step, another all-play time occurs at 48, followed by the turntablist having a solo part at 50, an all-play again at 52; a guitar instrument feature at 54 and another all-play at 56. Ending the sequence is a master end phrase, spoken by the selected master, again as will be discussed in more detail below.

It should be understood that FIG. 2 represents one particular sequence of control/play possible. The individual solo features can be initiated in a different sequence by the master or one or more of the individual musical instrument assemblies can play more than one solo (or none) during a particular pre-programmed song. The selected master musical assembly provides the control sequence for each instrument.

The selected master for a particular song and the other musical instruments keep in communication during the playing of a given programmed song, such as the situation where the selected master unit, e.g. the guitarist, maintains control over, through infrared communication, for instance, the drummer when the drummer is playing its feature. In this example, the guitarist master would send out a signal to the drummer instructing the drummer to reply regularly back to the master, indicating that the drummer is in fact present and playing, so that the master will know that the drummer is playing.

If the master does not receive a reply to its regular communication signal to the drummer in a given amount of time, such as 0.3 seconds, the master will then instruct the other musical assemblies to move immediately to the following play section of the sequence. The play flow then continues until the end of that pre-programmed song. In general, during the time that each musical assembly is playing its feature (solo), when that unit is finished, a signal is sent to the master indicating that the solo feature is over. The master then sends out a signal, instructing every musical assembly to play the next all-play section.

It should be understood that fewer than all of the musical instrument assemblies could be selected to play a given song. In such a case, the particular play sequence for that song will not include the musical assembly not participating. Theoretically, a system in which only one musical assembly is present is possible. This is accomplished by the on-off switches on the power unit of each instrument assembly. As discussed above each microprocessor unit could include a separate button (switch) for each pre-programmed song. All buttons which also act as the on switch power up each unit to a standby mode to receive infrared control signals. The on/off button powers up each unit to a standby mode to receive infrared control signals. When any of the control buttons are then pushed, the units then execute the pre-programmed songs.

FIG. 3 shows a table which includes another feature of the present system in which, when two or more musical instrument assemblies are present (playing the song), the selected master musical assembly for that song will speak a phrase at the beginning of the song and at the end of the song. This is shown at blocks 60 and 62 in FIG. 2. The initial and end phrases are pre-programmed and stored in the processor/storage unit of each musical instrument assembly, but can vary widely in content. FIG. 3 shows three initial and end phrases for the drummer, the bass, the deejay and the guitar. Again, in the arrangement shown, the selected master says the phrase at the beginning and end of each song.

It should be understood that a plurality of songs could be pre-recorded into the processor/storage unit of each musical assembly. The pre-recorded play sequence for a particular song can vary. In the particular embodiment shown two pre-programmed songs having parts for all the instruments assemblies are available, as well as two separate individual "jamming" parts for each instrument assembly, which can be individually selected for play by each instrument alone. It should be understood, however, that additional programmed songs featuring all or some of the instrument assemblies are possible, as well as additional jamming features for one or more of the instruments.

In the arrangement shown, as mentioned above, each musical instrument assembly can be selected to act as the master control unit, initiating the sequence, and maintaining communication control for each pre-programmed song. Further, the system can operate with less than all the musical assemblies present.

Also, as indicated above, each of the musical instrument assemblies has a particular action figure associated therewith positioned in juxtaposition with the musical instrument to give a "live band" look, along with the combined band sound.

Although a preferred embodiment of the invention has been described for purposes of illustration, it should be understood that various changes, modifications and substitutions might be incorporated in the embodiment without departing from the spirit of the invention, which is defined in the claims, which follow.

What is claimed is:

1. A miniature, self-controlled musical system, comprising:

a plurality of musical instrument assemblies, each assembly representing a selected musical instrument and including a processor/storage member for storing musical sounds associated with said musical instrument for a particular pre-programmed song for playing the musical sounds, and a control member for controlling the operating status of the musical instrument assembly;

an initiating selection element associated with each musical instrument assembly for selecting that musical instrument assembly as a master assembly for a particular pre-programmed song; and means for communicating control information from the selected master assembly to the remaining musical assemblies to initiate and play the particular song.

2. The system of claim 1, wherein each of the remaining musical assemblies communicate to the master musical assembly, and wherein the master musical assembly provides selected control information to each of the remaining musical assemblies depending upon communication with the remaining musical assemblies.

3. The system of claim 1, wherein the plurality of musical instrument assemblies includes a drummer musical instrument assembly, a bass guitar musical instrument assembly, a guitar musical instrument assembly and a turntable musical instrument assembly.

4. The system of claim 1, wherein each musical assembly can be in an off operating condition, a standby operating condition, and a playing operating condition.

5. The system of claim 3, wherein the plurality of musical instrument assemblies includes a turntablist assembly.

6. The system of claim 1, wherein the means for communication is infrared communication.

7. The system of claim 1, wherein the means for communication is wire communication.

8. The system of claim 1, wherein the processor/storage unit of each musical instrument assembly includes stored text information which is provided audibly by the selected master musical assembly for the particular song at the beginning or end of each song.

9. The system of claim 8, wherein audible text is provided audibly at both the beginning and the end of each song.

10. The system of claim 1, wherein a song is played in accordance with a particular programmed sequence controlled by the master assembly, including portions thereof which are played by all the musical assemblies and solo portions which are played by only one musical assembly.

11. The system of claim 10, wherein each musical assembly has a solo portion in the song, at times established by the pre-programmed sequence.

* * * * *